United States Patent [19]

Tanner

[11] Patent Number: 4,766,782

[45] Date of Patent: Aug. 30, 1988

[54] SCREW AND NAIL GUIDE

[76] Inventor: Bernard C. Tanner, #57 366-94th Avenue, Calgary, Alberta, Canada, T2J 5P1

[21] Appl. No.: 856,478

[22] Filed: Apr. 28, 1986

[30] Foreign Application Priority Data

May 7, 1985 [CA] Canada ..... 480982

[51] Int. Cl.[4] ..... B25C 3/00

[52] U.S. Cl. ..... 81/44; 227/152; 269/41

[58] Field of Search ..... 81/44, 23; 227/119, 227/139, 151, 152, 154, 155, 140, 147, 149; 269/1, 41, 42

[56] References Cited

U.S. PATENT DOCUMENTS

| | | | |
|---|---|---|---|
| 2,799,860 | 7/1957 | Myers | 81/44 |
| 2,911,022 | 11/1959 | Brown | 269/1 |
| 4,079,765 | 3/1978 | Hatayan | 81/44 |
| 4,201,258 | 5/1980 | Elmore | 81/44 |
| 4,221,248 | 9/1980 | Rix | 81/44 |

FOREIGN PATENT DOCUMENTS

| | | | |
|---|---|---|---|
| 563843 | 7/1975 | Switzerland | 81/44 |

*Primary Examiner*—Frederick R. Schmidt
*Assistant Examiner*—Bradley I. Vaught
*Attorney, Agent, or Firm*—Murray E. Thrift; Stanley G. Ade; Adrian D. Battison

[57] ABSTRACT

The guide comprises a pair of elongated matching bars with nail or screw bores through the mating surfaces thereof. The two bars are normally maintained slightly apart to lift over the heads of nails by compression springs and include rotating cam clamps which can close the strips together against the spring pressure. One embodiment includes end clamps for engaging the opposing edges of a board and the edge of a further board to be nailed at right angles thereto so that the nail positions are correctly located. Lengthwise and width adjustments may be provided in the guide. Another embodiment permits the guide to be slipped under nail heads that have been started in order to support the nail as it is further engaged by the hammer or out from under nail heads having been both started and initially driven. The device may have guide drillings both perpendicular and at an inclined angle to the surface upon which it is engaged.

21 Claims, 6 Drawing Sheets

SCREW AND NAIL GUIDE

BACKGROUND OF THE INVENTION

This invention relates to new and useful improvements in nail guides although it will be appreciated that it can be used, under certain circumstances, to guide screws as well.

Conventionally, nails have to be held individually between the thumb and forefinger of the operator whereupon the head is stuck with a hammer to start the nail and then further engaged with the work piece by repeated blows of the hammer or other such force producing implement, until the nail is driven fully into position.

Two difficulties arise with the conventional method of nailing, particularly when relatively thin and long finishing nails are used. Firstly a misplaced blow of the hammer may cause the nail to bend over from the area of penetration with the surface and secondly, it is sometimes difficult to position the nail so that it engages through the work piece and into a further work piece. An example of the second difficulty which may be encountered is when a shelf end is being nailed to an end board at right angles to the end board under which circumstances, it will be appreciated, the nail should penetrate the shelf end approximately along the medial line of the end and this is sometimes extremely difficult to gauge.

Furthermore, many people including the young, the old and the handicapped, often encounter difficulties in accomplishing even minimal nailing tasks as do the unskilled.

Although professional nailing machines exist, these are for mass production purposes and are extremely involved and usually include automatic nailing devices.

SUMMARY OF THE INVENTION

The present invention overcomes difficulties encountered with nailing a work piece, particularly when relatively thin and long nails such as finishing nails are utilized.

Several embodiments are shown and which may be divided into two different groups. The first group utilizes a nailing guide with is particularly suitable for use when one board is being nailed at right angles to the other with the nail extending through the thickness of one board and into the end of the other board such as a shelf to an end piece.

The second group consists of a nail or screw guide which may support a plurality of nails for engagement with a work piece along a line either gauged by eye or drawn thereon.

In accordance with the invention there is provided a nail or screw guide device comprising in combination:

(a) A pair of longitudinally extending bars including opposing faces.

(b) Means mounting said bars for movement towards and apart from one another, thus defining a closed position and an open position, the said opposing faces of said bars being in inter-facial relationship when in the closed position and spaced apart from one another when in the open position.

(c) Nail or screw guiding partial bores on at least one of said faces extending from the upper to the lower side of said opposing faces.

(d) Means co-operating between said bars to retain said bars in the parallel relationship one with the other and to selectively move said bars from the closed position to the open position and vice versa.

In accordance with a further embodiment of the invention there is provided a nail or screw guide for use with a first board and a second board situated at right angles thereto as in a shelf to be attached to an end panel; comprising in combination:

(a) A pair of longitudinally extending bars including opposing faces.

(b) Means mounting said bars for movement towards and apart from one another thus defining a closed position and an open position, the said opposing faces of said bars being in inter-facial relationship when in the closed position and spaced apart from one another when in the open position.

(c) Nail or screw guiding partial bores on at least one of said faces extending from the upper to the lower side of said opposing faces.

(d) Means co-operating between said bars to retain said bars in the parallel relationship one with the other and to selectively move said bars from the closed position to the open position and vice versa.

(e) Further means pivoted adjacent each end of said bars to detachably engage the edges of said first board with said bars engaging and spanning one planar surface of said second board to locate the said opposing faces of said bars substantially in alignment with the transverse centre line of said first board.

Another advantage of the invention is to provide a device of the character herein described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
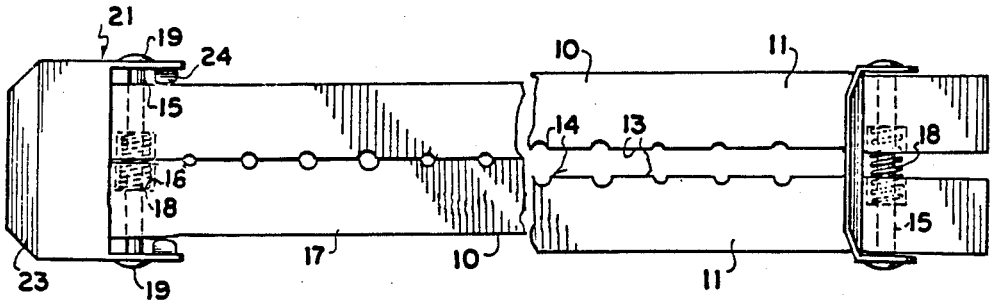
FIG. 1 is a top plan view of an embodiment for use on flat surfaces and showing one end open and one end closed.

Proceding therefore to describe the invention in detail reference should first be made to FIGS. 1 through 5.

This shows a nail and/or screw guide usable on a flat surface in which the line can readily be ascertained.

It consists of a pair of elongated bars 10 each have an upper face 11, a lower face 12 and opposing inner faces 13.

The opposing inner faces 13 have semi- cylindrical bores 14 preferably in both faces 13 and with the semi-bores 14 in matching relationship with similar bores on the opposite face so that when the two bars are in inter-facial contact or in the closed position, the bores form a cylindrical bore through the device. These bores may be of different diameters to suit nails and/or screws of the various diameters.

Means are provided to mount the bars in the desired spaced and parallel relationship when in the opened position, said means taking the form of transverse mounting pins 15 extending from side to side through both of the bars 10 which are provided with transverse drillings to receive these pins. These drillings are enlarged as at 16, from the inner faces 13 of the bars towards the outer faces 17 to receive a compression spring 18 surrounding the pin 15 and normally urging the two bars apart towards the headed ends 19 of the pins.

When in the opened position, the space between the opposing faces 13 is sufficient to enable the device to be engaged over nails which may have been started into a working surface whereupon closing of the bars around these nails as will hereinafter be described, will provide support for the initial driving of the nail or nails.

Alternatively of course, the device may be place in the desired location upon a work surface and nails inserted through the relevant bores in order to support same while they are both started and initially driven. Then, when opened, the device can be removed over the nail heads.

Figure 2:
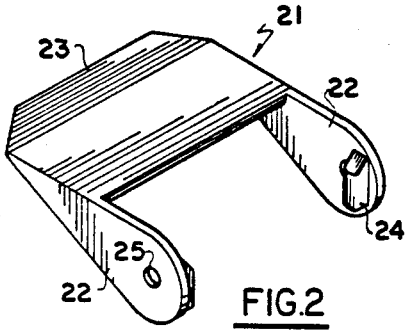
FIG. 2 is an isometric view of one of the cam clamps per se.
Figure 3:
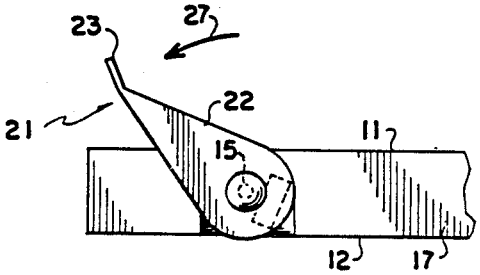
FIG. 3 is a fragmentary side elevation of the closed end of FIG. 1.
Figure 4:
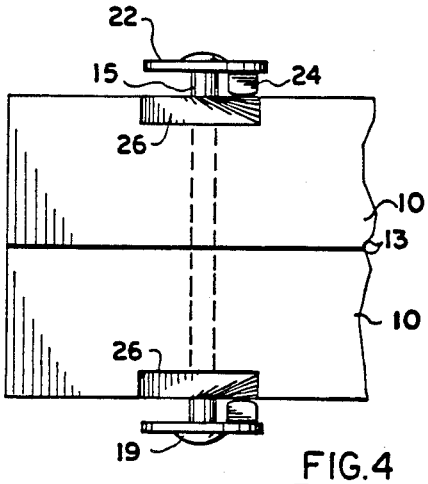
FIG. 4 is a fragmentary under side view of FIG. 3.

Camming levers and clamps collectively designated 21, are provided upon the pivot pins 15, adjacent each end of the bars and are shown clearly in FIG. 2. They include a pair of spaced and parallel ears 22 apertured to engage over the ends of pins 15, said ears extending from a finger lever portion or plate 23.

Figure 5:
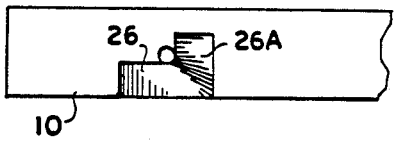
FIG. 5 is a fragmentary side elevation of one end of the bar showing the camming ramp.
Figure 6:
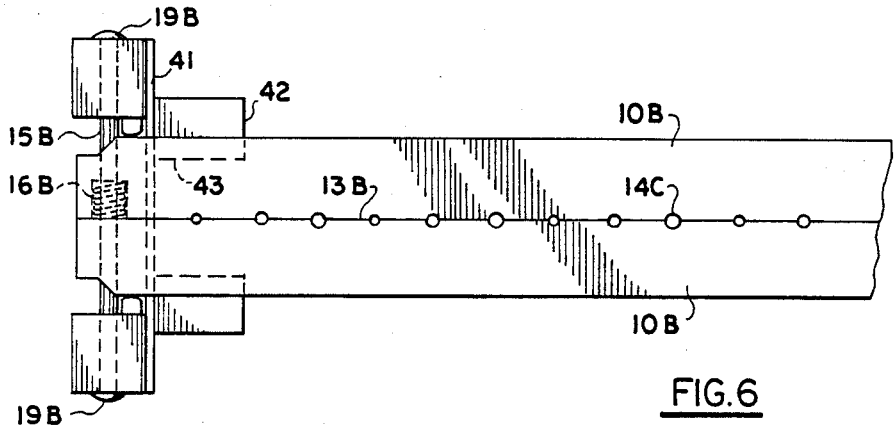
FIG. 6 is a fragmentary view of the embodiment of FIG. 5A shown in the closed position but removed from the board for clarity.

Cylindrical cams 24 are secured or formed on the inner surfaces of the ear forwardly of the apertures 25 through which pin 15 engages and reference to FIG. 5 will show that small ramps 26 are formed on the lower portion of the outer surfaces of the bars 10. When the camming levers are in the uppermost position shown on the right hand end of FIG. 1, the camming cylinders 24 rest within the ramp recess 26 thus enabling the compression springs 18 to urge the bars apart as shown at the right hand end of FIG. 1.

However, as the camming levers are rotated outwardly relative to the ends, in the direction of arrow 27, the cylinders 24 ride up the ramps 26A thus forcing the bars together against pressure of springs 18 so that the surfaces 13 are in substantial inter-facial relationship with the matching bores 14 surrounding nails which may have been started into a work surface or, alternatively, providing guides through which nails may be inserted, started and initially driven.

Reference should next be made to FIGS. 17 through 20 which is a modification of the first embodiment above described but is designed specifically for operation with one camming lever assembly and is designed to be slipped under the heads of nails which have been initially started into a work surface or slipped out from under large heads of nails, screws or picture hooks having been both started and initially driven.

It consists of a pair of elongated bars 10A having matching semi-bores 14A formed in a manner similar to that hereinbefore described. These semi-bores 14A, and semi-bores 14 are situated perpendicular to the longitudinal axis of the bars and extend from the upper surface 11 to the lower surface 12 as clearly shown.

Figure 19:
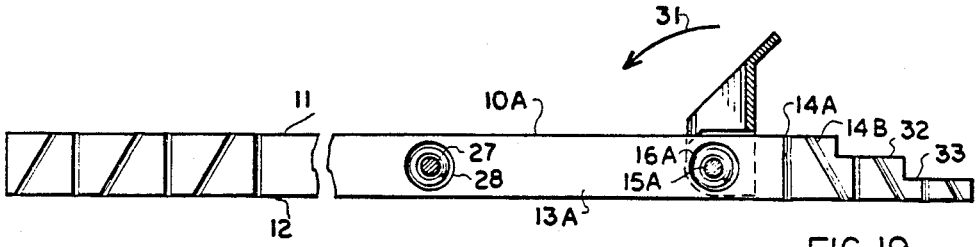
FIG. 19 is a longitudinal cross section of FIG. 18.

Also provided in this embodiment (and which of course can be provided in all other embodiments) are semi-bores 14B which are situated diagonally with respect to the bores 14 and 14A as clearly shown in FIG. 19. This enables nails to be supported and driven at an inclined angle from the planar surface of the work piece and are useful for the purposes such as driving nails for picture hooks and the like. These two bars 10A are mounted upon a transverse pin 15A extending through drillings in the bars intermediate the ends thereof and retained by means of heads 19A.

A further support pin 27 engaged in blind bores 28 extending from the inner surfaces 13A of the bars and a compression spring 18A normally urges the bars apart restrained by the headed pin 19A. The bores for the pin 15A is also enlarged as at 16A to receive a further compression spring 18A which, in conjunction with the spring 18A around pin 27, urges the two bars apart when in the opened position shown in FIG. 18.

Figure 20:
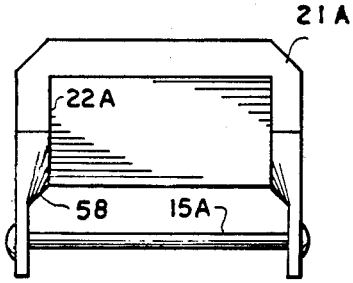
FIG. 20 is an end view of the camming member of FIG. 18.

The camming lever assembly collectively designated 21A also includes a pair of ears 22A engaging around pin 15A and the inner surfaces 58 of the ears are formed into cams as clearly shown in FIG. 20. The upper corners 30 of the bars in the general area of the camming lever assembly 21A are chamfered so that as the camming lever 21A is moved from the substantially vertical position shown in FIG. 18 in the direction of arrow 31, the camming portions of the ears 22A ride over the chamfered corners 30 thus forcing the two bars together into the closed position shown in FIG. 17, it being understood that the location of the camming lever 21A is sufficiently towards the centre of the bars to allow them to move parallel to one another over pins 15A and 27 against the pressure of springs 18A.

With this construction, the open ends of the bars may be engaged under the heads of nails which may have been started in the work piece whereupon the bars may be clamped around the shanks thereof.

Also of note, and shown specifically in FIG. 19 is that one of the ends of each of the bars 10A are stepped as at 32 and 33 with the steps also being provided with semi-bores 14A and 14B designed specifically for use with nails of different lengths. Once again this arrangement can of course be used in the embodiment previously described in FIGS. 1 through 5.

Also of importance is the preferred embodiment of the camming lever assembly 21A which can be used in all of the embodiments with the exception of that shown in FIGS. 5A through 11 inclusive.

The previous two embodiments deal with nail guides which can be used on flat surfaces with various hole sizes and can support or guide nails being driven perpendicular to the surface upon which the device is being used or, at an inclined angle such as for picture hooks and the like.

The next two embodiments shown in FIGS. 5A through 16 are designed specifically for use in furniture manufacture or the like in which one board has to be secured as by nails at right angles to another board with the nails being driven through the thickness of one board and into the end of the other board. Examples are the attachment of shelves to an end piece, or furniture pieces situated at right angles to one another.

Under these circumstances it is desirable that the board being secured by the end thereof be positioned precisely under the bores of the nail guide so that when the nails are driven through the thickness of the one board into the end of the second board, the nails lie substantially along the transverse centre line of the end.

Dealing first with the embodiments specifically shown in FIGS. 5A through 11, reference character 34 shows in side elevation, the end of what is defined as a first board in position upon the planar surface 35 of a second board with nails 36 to be driven from the other planar side 37 of the second board 35, through the second board and into the end 38 of the first board 34.

The guide device is similar in construction to that hereinbefore described so that once again, similar reference characters have been given with a different suffix.

The bars 10B are provided with semi-bores 14C in a manner similar to that previously described and once again these can of course be perpendicular to the surface upon which it is being used or can be at an inclined angle similar to the semi-bores 14B, if it is desired to "toe nail" any particular nailing function.

Figure 7:
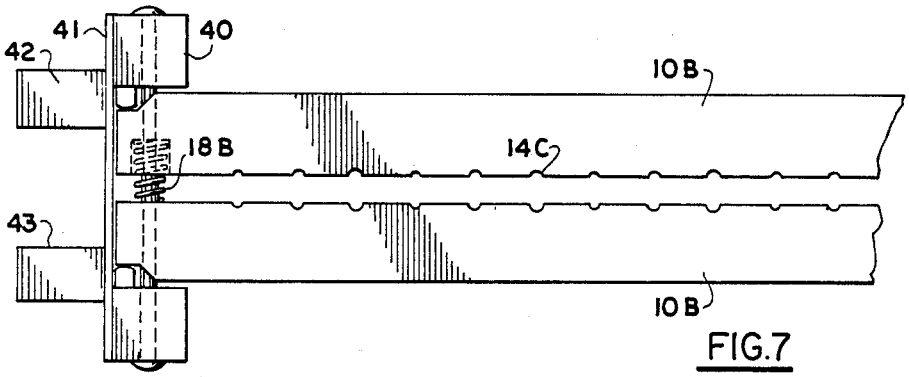
FIG. 7 is a view similar to FIG. 6 but showing the bars in the open position.
Figure 5A:
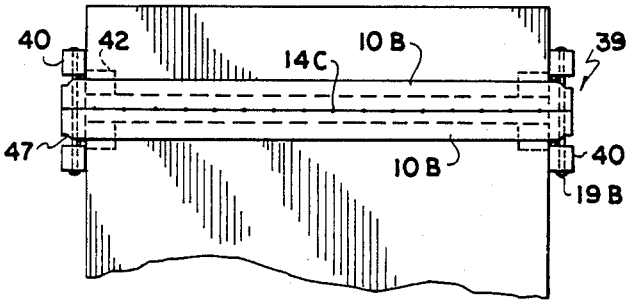
FIG. 5A is a fragmentary top plan view of an alternative embodiment of the device showing same engaged upon a first board with a second board at right angles thereto.

Pivot pins 15B extend through transverse drillings adjacent each end of the bars and these drillings are enlarged as at 16B, from the inner faces 13B in a manner similar to that hereinbefore described so that compression springs 18B surrounding the pins 15B, normally urge the bars apart in spaced relationship as clearly shown in FIG. 7.

Figure 8:
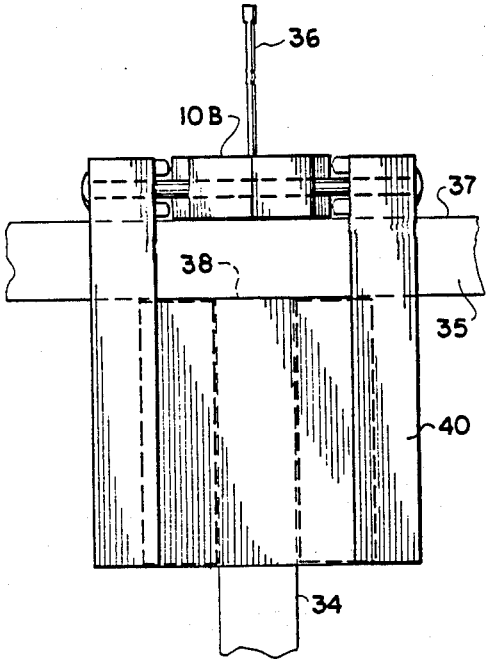
FIG. 8 is a fragmentary end view of FIG. 6 with the device in the closed position.
Figure 9:
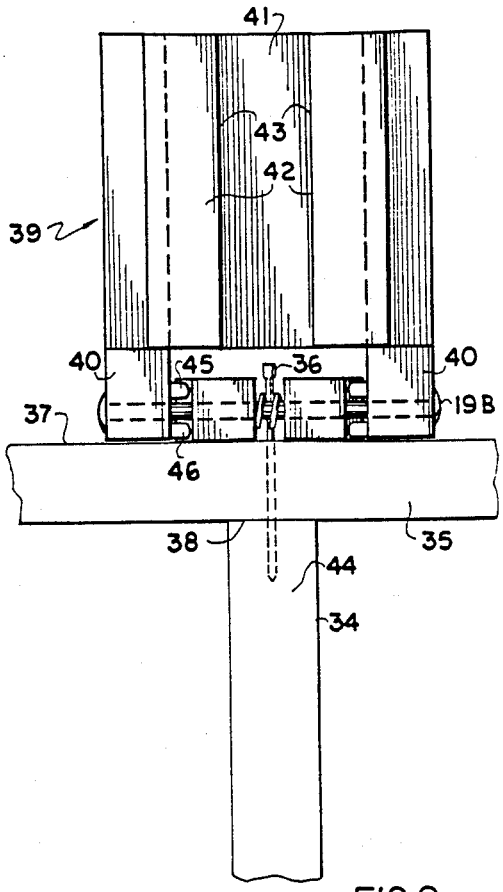
FIG. 9 is a view similar to FIG. 8 but showing the device in the open position.
Figure 10:
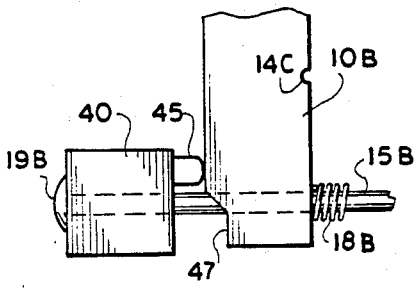
FIG. 10 is a fragmentary enlarged view showing the camming action to close the bars.
Figure 11:
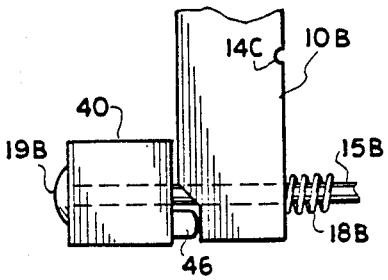
FIG. 11 is a view similar to FIG. 10 but showing the camming action in the open position.
Figure 12:
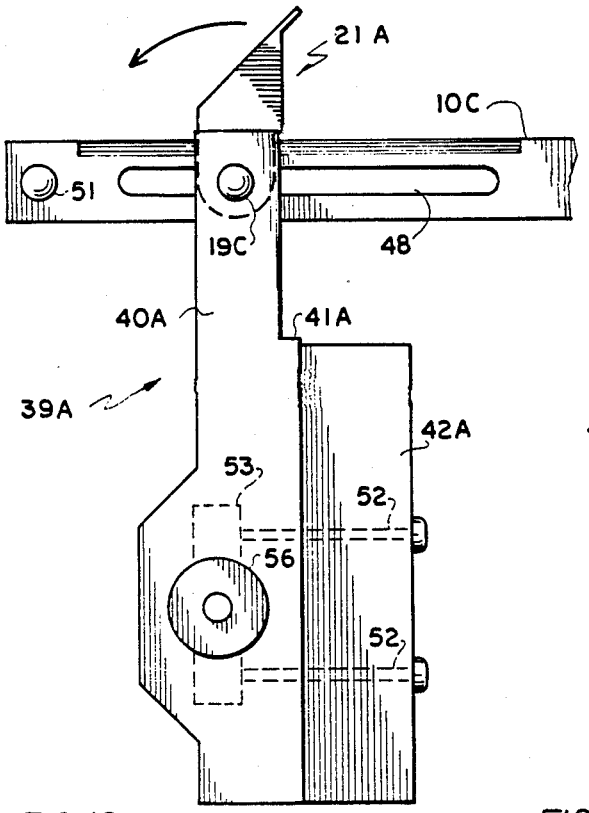
FIG. 12 is a fragmentary side elevation of an alternative embodiment in the open position in which one of the end portions is adjustable lengthwise along the bars.
Figure 13:
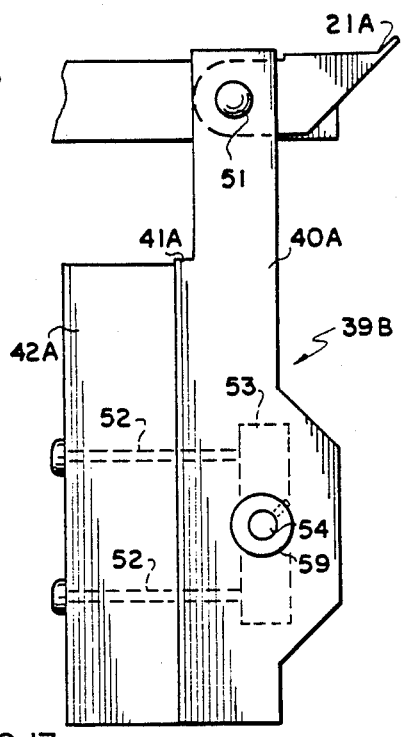
FIG. 13 is a view similar to FIG. 12 but showing the opposite end portion thereof and in the closed position.
Figure 16:
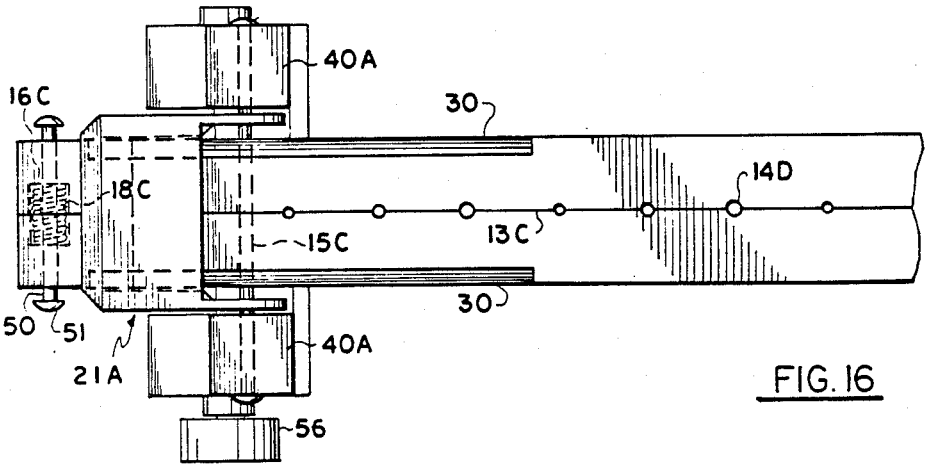
FIG. 16 is a top plan view of FIG. 12 showing the device in closed position.
Figure 14:
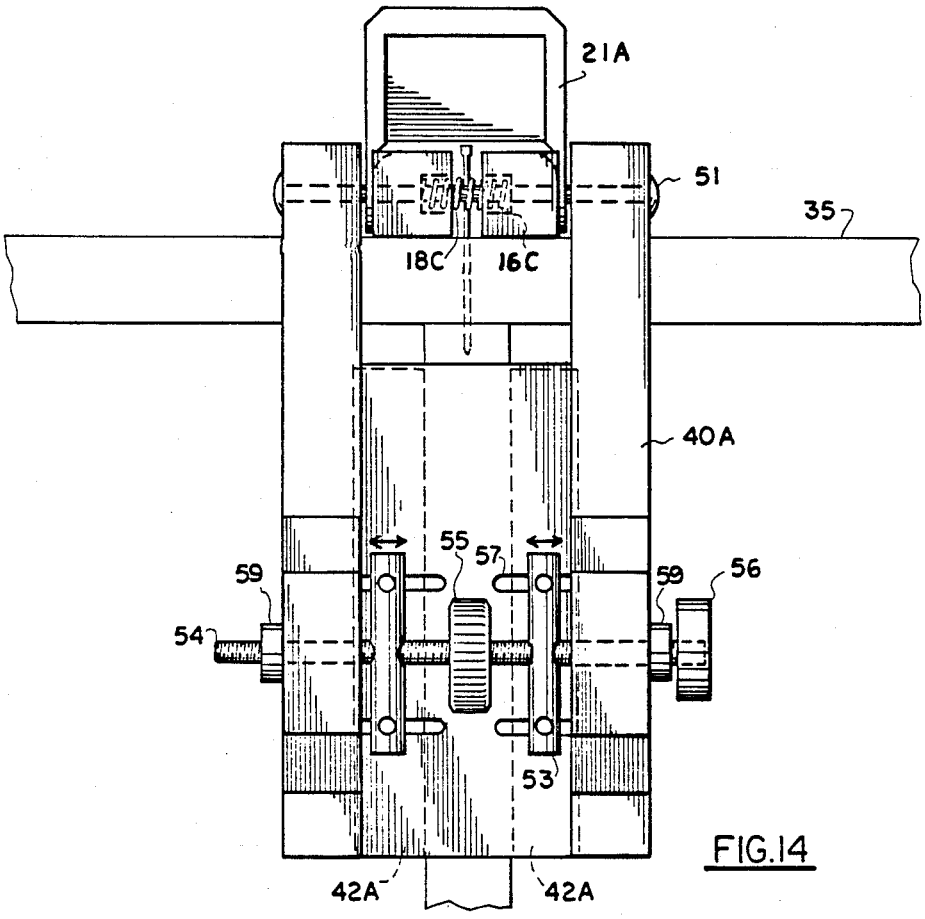
FIG. 14 is a fragmentary end view of FIG. 13 showing the device in the open position.
Figure 15:
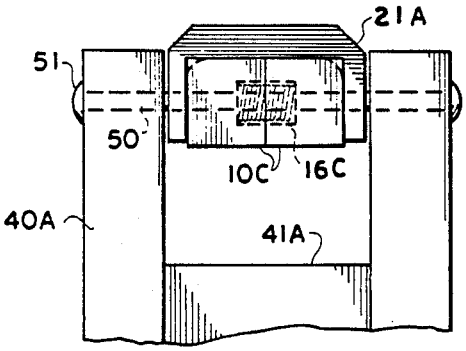
FIG. 15 is a view similar to FIG. 14 but showing the device in the closed position.
Figure 17:
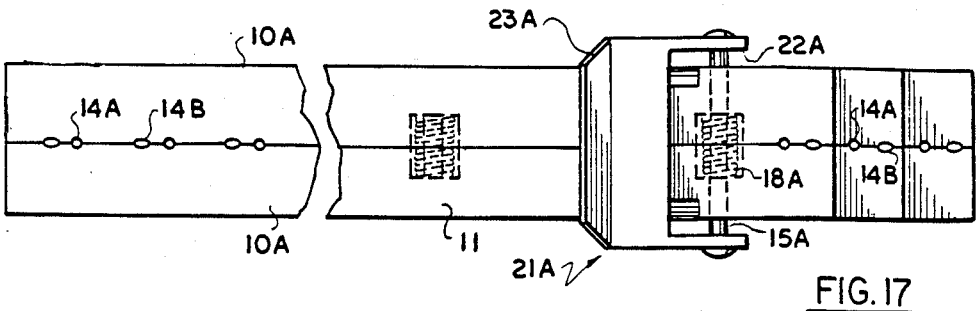
FIG. 17 is a fragmentary top plan view of a further embodiment.
Figure 18:
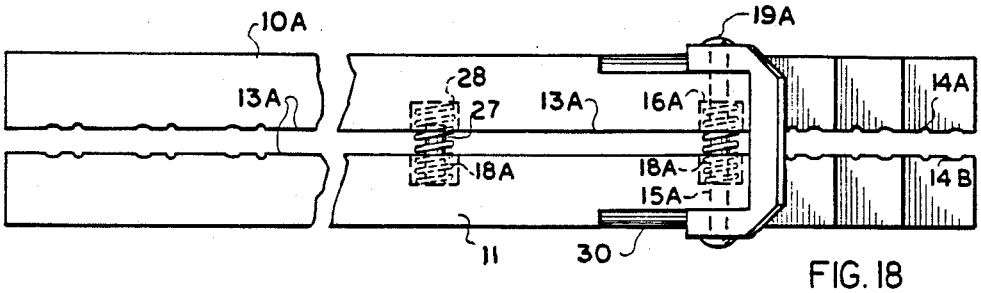
FIG. 18 is a view similar to FIG. 17 but in the open position.

Locating assemblies collectively designated 39 are pivotedly mounted upon each end pin 15B and can be moved from the opened position shown in FIG. 9 under which circumstances the bars are at their fullest spaced apart relationship, to the board edge clamping position shown in FIG. 8 under which circumstances the bars are in their closed position.

The locating assemblies 39 consist of a pair of spaced and parallel members 40 pivoted by the upper ends thereof to the outer ends of pins 15B and retained by the heads 19B on each end of the pin.

A plate 41 (see FIGS. 6 and 7) is secured to the inner sides of the members 40 (when in the position shown in FIG. 8) and board edge engaging members 42 are in turn secured to the other side of plate 41 in spaced and parallel relationship with the inner edges 43 being spaced apart sufficiently to snugly engage over the width or edge 44 of the second board 34, once again when in the position shown in FIG. 8. Reference to FIG. 8 will show that the bars 10B are situated on the upper surface 37 of the second board 35 and are of sufficient length so that when the locating assemblies 39 are moved to the position shown in FIG. 8, the locating members 42 engage snugly over each longitudinal edge of the first board 34 thus maintaining it in direct alignment with the nail support bores 14C. This allows nails 36 to be driven through the board 35 and into the end of the board 34 substantially along the centre line of the end as shown in phantom in FIG. 9.

The rotation of the locating assembly from the position shown in FIG. 9 to the position shown in FIG. 8 also acts as the camming assembly for closing the two bars into the position shown in FIG. 8 and to allow the springs 18B to urge the bars apart when moved to the position shown in FIG. 9.

The camming assembly is preferably of the type illustrated and described in FIGS. 17 through 20 but alternatively, projecting pins 45 and 46 may act as cams in cut away portions 47 formed on the ends of the bars 10B. When in the position shown in FIGS. 7 and 9, the pins rest within the recesses so that springs 18B move the bars apart or to the opened position and when in the position shown in FIGS. 6 and 8, the pins cam over the outer surfaces of the bars and force them together against pressure of springs 18B.

It will of course be appreciated that the components 39 can be formed in one piece with the members 40, 41 and 42 being formed integrally.

Dealing next with the embodiment shown in FIGS. 12 through 16, it is similar to that just described and illustrated in FIGS. 5A through 11 with the exception that one locating assembly 39A, which is similar in operation to assembly 39, is adjustable lengthwise relative to the bars 10C through elongated closed ended slots 48 formed transversely through the bars adjacent one end thereof.

In this connection, pin 15C extends through the upper ends of the components 39A and this enables the one assembly 39A to be adjusted lengthwise by sliding along slots 48 thus adjusting the assembly for use with second boards 35 of various widths.

In this connection, the two bars 10C are slideably mounted upon guide pins 50 adjacent each end thereof with heads 51 so that the bars are normally urged apart by means of compression springs 18C situated within blind bores 16C extending from the inner faces 13C. The opening and closing of the bars 10C is similar to that hereinbefore described and preferably utilizes the camming plate component 21A.

The movable component 39A and the non-end shiftable corresponding component 39B at the other end of the bars 10C both are provided with board edge engaging members 42A similar to members 42 hereinbefore described. However, these members are mounted upon plates 41A which in turn are secured to supports 40A pivoted by the upper ends thereof upon the cross pins 15C and 50 and also movable from the position shown in FIGS. 12 through 16 to a position similar to that shown in FIG. 9 and vice versa.

The locating members 42A are mounted upon pins 52 which in turn are supported at right angles to vertical supports 53 screw threadably engaged upon a left and right handed threaded member 54 which extends between the supports 40A adjacent the lower ends thereof and held in position by collars 59. This double threaded bolt 54 may be rotated either by a knurled nut 55 between the members 53 or by an end nut 56 depending upon design. Rotation of bolt 54 moves the locating members 42A inwardly or outwardly along slots 57 within the plate 41A and through which the pins 52 pass as clearly shown in FIG. 14, thus adjusting for various thickness of first boards 34.

Once again, in all embodiments semi-bores of various dimensions may be provided and the various camming actions are inter-changeable.

Although the device has been described for use with nails and/or screws, it will nevertheless be appreciated that it is readily adaptable for use as a drilling guide for pre-drilling apertures through work pieces for the reception of screws and the like.

I claim:

1. A nail or screw guide device comprising in combination:

(a) a pair of longitudinally extending bars including opposing faces, (b) means mounting said bars for movement towards and apart from one another thus defining a closed position and an open position, the said opposing faces of said bars being in parallel inter-facial relationship when in the closed position and in parallel spaced apart relationship when in the open position, (c) nail or screw guiding partial bores on at least one of said faces extending from the upper to the lower side of said opposing faces, and (d) means co-operating between said bars to retain said bars with the opposing faces in parallel relationship one with the other and to selectively move said bars from the closed position to the open position and vice versa.

2. The device according to claim 1 in which said means co-operating between said bars is situated adjacent each end of said bars.

3. The device according to claim 1 in which said means cooperating between said bars is situated intermediate the ends of said bars, said ends being open and unobstructed when said bars are in the open position whereby said bars may be slipped from under the heads of nails partially engaged with the surface upon which the device is situated.

4. The device according to claim 1 in which said partial bores are formed in matching positions on each of said opposing faces.

5. The device according to claim 4 in which said partial bores are perpendicular to the longitudinal axis of said bars.

6. The device according to claim 4 in which said partial bores are inclined at an angle from the longitudinal axis of said bars.

7. The device according to claim 1 in which the vertical thickness of the bars varies in at least one step to suit nails and screws of different lengths, said partial bores extending also through the stepped portions of said bars.

8. The device according to claim 4 in which said partial bores are of various sizes along the length of said bars to suit nails and screws of various diameters.

9. A nail or screw guide for use with a first board and a second board situated at right angles thereto as in a shelf to be attached to an end panel; comprising in combination:

(a) a pair of longitudinally extending bars including opposing faces, (b) means mounting said bars for movement towards and apart from one another thus defining a closed position and an open position, the said opposing faces of said bars being in inter-facial relationship when in the closed position and spaced apart from one another when in the open position, (c) nail or screw guiding partial bores on at least one of said faces extending from the upper to the lower side of said opposing faces, (d) means co-operating between said bars to retain said bars in the parallel relationship one with the other and to selectively move said bars from the closed position to the open position and vice versa, and (e) further means pivoted adjacent each end of said bars to detachably engage the edges of said first board with said bars engaging and spanning one planar surface of said second board to locate the said opposing faces of said bars substantially in alignment with the transverse centre line of said first board.

10. The device according to claim 9 in which said partial bores are formed in matching positions on each of said opposing faces.

11. The device according to claim 9 in which said partial bores are perpendicular to the longitudinal axis of said bars.

12. The device according to claim 9 in which said partial bores are inclined at an angle from the longitudinal axis of said bars.

13. The device according to claim 9 in which said semi-bores are of various sizes along the length of said bars to suit nails and screws of various diameters.

14. The device according to claim 9 in which said further means includes a pair of spaced and parallel locating members selectively engagable one upon opposite faces of said first board adjacent one edge thereof and support means for said locating members pivotally attached by one end thereof to adjacent each end of said bars and movable in a vertical plane from a disengaged position to a first board engaging position substantially perpendicular to the longitudinal axis of said bars.

15. The device according to claim 14 in which said locating members also include means to move said bars from the opened position when said locating members are in the disengaged position to the closed position when in the first board engaging position.

16. The device according to claim 14 in which said means cooperating between said bars to retain said bars in parallel relationship one with the other, includes a pivot pin extending transversely across said bars at the ends thereof, said locating members being independently pivoted upon said pivot pins.

17. The device according to claim 14 in which at least one of said further means is selectively adjustable along the length of said bars for engagement of boards of various widths.

18. The device according to any of claim 14 in which both of said pairs of locating members are selectively adjustable in the spaced apart relationship thereof for engagement with first boards of various thicknesses.

19. A nail or screw guide device comprising in combination:

(a) a pair of longitudinally extending bars including opposing faces, (b) means mounting said bars for movement towards and apart from one another thus defining a closed position and an open position, the said opposing faces of said bars being in parallel inter-facial relationship when in the closed position and in parallel spaced apart relationship when in the open position, (c) nail or screw guiding partial bores on at least one of said faces extending from the upper to the lower side of said opposing faces, and (d) means co-operating between said bars to retain said bars with the opposing faces in parallel relationship one with the other and to selectively move said bars from the closed position to the open position and vice versa, comprising a cam lever pivotally mounted to said bars and spanning same, and movable from a first position whereby said bars are in the closed position, to a second position whereby said bars are in the open position, said cam lever including cam faces operatively engagable with said bars when moving from the second position to the first position to move said bars towards one another, and compression spring means operatively extending between said bars normally urging said bars towards the open position.

20. A nail or screw guide device comprising in combination:

(a) a pair of longitudinally extending bars including opposing faces, (b) means mounting said bars for movement towards and apart from one another thus defining a closed position and an open position, the said opposing faces of said bars being in parallel inter-facial relationship when in the closed position and in parallel spaced apart relationship when in the open position, (c) nail or screw guiding partial bores on at least one of said faces extending from the upper to the lower side of said opposing faces, and (d) means co-operating between said bars to retain said bars in parallel relationship one with the other and to selectively move said bars from the closed position to the open position and vice versa comprising levers pivotally mounted to said bars adjacent the respective ends of the bars and spanning same, and movable from a first position whereby said bars are in the closed position, to a second position whereby said bars are in the open position, each said cam lever including cam faces operatively engagable with said bars when moving from the second position to the first position to move said bars towards one another, and compression spring means operatively extending between said bars normally urging said bars towards the open position.

21. The device according to claim 16 in which said means co-operating between said bars to retain said bars in parallel relationship one with the other includes cam members adjacent the upper ends of said support members for said locating members, operatively engagable with the outer sides of said bars.

* * * * *